US006523350B1

(12) United States Patent
Mancini et al.

(10) Patent No.: US 6,523,350 B1
(45) Date of Patent: Feb. 25, 2003

(54) FUEL INJECTOR FUEL CONDUITS WITH MULTIPLE LAMINATED FUEL STRIPS

(75) Inventors: Alfred A. Mancini, Cincinnati, OH (US); Peter W. Mueller, Morrow, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/973,330

(22) Filed: Oct. 9, 2001

(51) Int. Cl.[7] ..... F02C 1/00

(52) U.S. Cl. ..... 60/740; 123/468; 123/469; 138/118

(58) Field of Search ..... 60/740; 123/456, 123/468, 469, 470; 138/111, 116, 118, 120

(56) References Cited

U.S. PATENT DOCUMENTS

| | | | | |
|---|---|---|---|---|
| 4,854,127 A | * | 8/1989 | Vinson et al. | 60/740 |
| 5,423,178 A | | 6/1995 | Mains | |
| 5,570,580 A | | 11/1996 | Mains | |
| 5,598,696 A | | 2/1997 | Stotts | |
| 5,761,907 A | | 6/1998 | Pelletier et al. | |
| 6,021,635 A | | 2/2000 | Gaag et al. | |
| 6,076,356 A | | 6/2000 | Pelletier | |
| 6,276,141 B1 | | 8/2001 | Pelletier | |
| 6,321,541 B1 | | 11/2001 | Wrubel et al. | |

OTHER PUBLICATIONS

"Internally Heatshielded Nozzle", PCT International Publication No. WO 97/34108, International Publication Date—Sep. 18, 1997.

"Multi–Circuit, Multi–Injection Point Atomizer", Parker Aerospace (Tech 56) Proprietary Information, (41 pages), R. Fowler, Feb. 3, 2000.

* cited by examiner

*Primary Examiner*—Charles G. Freay
*Assistant Examiner*—John F Belena
(74) *Attorney, Agent, or Firm*—William Scott Andes; Steven J. Rosen

(57) ABSTRACT

A fuel injector has at least two generally parallel feed strips. Each of the feed strips is constructed from a single bonded together pair of lengthwise extending plates, each plate having a single row of widthwise spaced apart and lengthwise extending parallel grooves. The plates in each strip are bonded together such that opposing grooves in each of the plates are aligned forming internal fuel flow passages through the length of the strip from an inlet end to an outlet end of the strip. The inlet ends are spaced apart from each other and the outlet ends are spaced apart from each other. Each of the feed strips has one or more convolutions along a length of the strip and the feed strips are not bonded together along the convolutions. The feed strips may be spaced apart from each other or may be in contact with each other.

31 Claims, 7 Drawing Sheets

FUEL INJECTOR FUEL CONDUITS WITH MULTIPLE LAMINATED FUEL STRIPS

BACKGROUND OF THE INVENTION

FIELD OF THE INVENTION

The present invention relates generally to fuel injectors, and more particularly, to fuel conduits for fuel injectors and the injectors for gas turbine engine combustors.

Fuel injectors, such as in gas turbine engines, direct pressurized fuel from a manifold to one or more combustion chambers. Fuel injectors also prepare the fuel for mixing with air prior to combustion. Each injector typically has an inlet fitting connected to the manifold, a tubular extension or stem connected at one end to the fitting, and one or more spray nozzles connected to the other end of the stem for directing the fuel into the combustion chamber. A fuel conduit or passage (e.g., a tube, pipe, or cylindrical passage) extends through the stem to supply the fuel from the inlet fitting to the nozzle. Appropriate valves and/or flow dividers can be provided to direct and control the flow of fuel through the nozzle. The fuel injectors are often placed in an evenly-spaced annular arrangement to dispense (spray) fuel in a uniform manner into the combustor chamber. An air cavity within the stem provides thermal insulation for the fuel conduit. A fuel conduit is needed that can be attached to a valve housing and to the nozzle. The fuel conduit should be tolerant of low cycle fatigue (LCF) stresses caused by stretching of the stem which houses the conduit and which undergoes thermal growth more than the cold conduit. The attachment of the conduit to the valve housing should be a reliable joint which doesn't leak during engine operation. Fuel leaking into the hot air cavity can cause detonations and catastrophic over pressures.

A fuel injector typically includes one or more heat shields surrounding the portion of the stem and nozzle exposed to the heat of the combustion chamber. The heat shields are used because of the high temperature within the combustion chamber during operation and after shut-down, and prevent the fuel from breaking down into solid deposits (i.e., "coking") which occurs when the wetted walls in a fuel passage exceed a maximum temperature (approximately 400° F. (200° C.) for typical jet fuel). The coke in the fuel nozzle can build up and restrict fuel flow through the fuel nozzle rendering the nozzle inefficient or unusable. One such heat shield assembly is shown in U.S. Pat. No. 5,598,696 and includes a pair of U-shaped heat shield members secured together to form an enclosure for the stem portion of the fuel injector. At least one flexible clip member secures the heat shield members to the injector at about the midpoint of the injector stem. The upper end of the heat shield is sized to tightly receive an enlarged neck of the injector to prevent combustion gas from flowing between the heat shield members and the stem. The clip member thermally isolates the heat shield members from the injector stem. The flexibility of the clip member permits thermal expansion between the heat shield members and the stem during thermal cycling, while minimizing the mechanical stresses at the attachment points.

Another stem and heat shield assembly is shown in U.S. Pat. No. 6,076,356 disclosing a fuel tube completely enclosed in the injector stem such that a stagnant air gap is provided around the tube. The fuel tube is fixedly attached at its inlet end and its outlet end to the inlet fitting nozzle, respectively, and includes a coiled or convoluted portion which absorbs the mechanical stresses generated by differences in thermal expansion of the internal nozzle component parts and the external nozzle component parts during combustion and shut-down. Many fuel tubes also require secondary seals (such as elastomeric seals) and/or sliding surfaces to properly seal the heat shield to the fuel tube during the extreme operating conditions occurring during thermal cycling. Such heat shield assemblies as described above require a number of components, and additional manufacturing and assembly steps, which can increase the overall cost of the injector, both in terms of original purchase as well as a continuing maintenance. In addition, the heat shield assemblies can take up valuable space in and around the combustion chamber, block air flow to the combustor, and add weight to the engine. This can all be undesirable with current industry demands requiring reduced cost, smaller injector size ("envelope") and reduced weight for more efficient operation. Because of limited fuel pressure availability and a wide range of required fuel flow, many fuel injectors include pilot and main nozzles, with only the pilot nozzles being used during start-up, and both nozzles being used during higher power operation. The flow to the main nozzles is reduced or stopped during start-up and lower power operation. Such injectors can be more efficient and cleaner-burning than single nozzle fuel injectors, as the fuel flow can be more accurately controlled and the fuel spray more accurately directed for the particular combustor requirement. The pilot and main nozzles can be contained within the same nozzle stem assembly or can be supported in separate nozzle assemblies. Dual nozzle fuel injectors can also be constructed to allow further control of the fuel for dual combustors, providing even greater fuel efficiency reduction of harmful emissions.

A typical technique for routing fuel through the stem portion of the fuel injector is to provide a fuel conduit having concentric passages within the stem, with the fuel being routed separately through different passages. The fuel is then directed through passages and/or annular channels in the nozzle portion of the injector to the spray orifice(s). U.S. Pat. No. 5,413,178, for example, discloses concentric passages where the pilot fuel stream is routed down and back along the main nozzle for cooling purposes. This can also require a number of components, and additional manufacturing and assembly steps, which can all be contrary to desirable cost and weight reduction and small injector envelope.

U.S. Pat. No. 6,321,541 addresses these concerns and drawbacks with a fuel injector that includes an inlet fitting, a stem connected at one end to the inlet fitting, and one or more nozzle assemblies connected to the other end of the stem and supported at or within the combustion chamber of the engine. A fuel conduit in the form of a single elongated laminated feed strip extends through the stem to the nozzle assemblies to supply fuel from the inlet fitting to the nozzle(s) in the nozzle assemblies. An upstream end of the feed strip is directly attached (such as by brazing or welding) to the inlet fitting without additional sealing components (such as elastomeric seals). A downstream end of the feed strip is connected in a unitary (one piece) manner to the nozzle. The single feed strip has convolutions along its length to provide increased relative displacement flexibility along the axis of the stem and reduce stresses caused by differential thermal expansion due to the extreme temperatures in the combustion chamber. This reduces or eliminates a need for additional heat shielding of the stem portion of the injector.

The laminate feed strip and nozzle are formed from a plurality of plates. Each plate includes an elongated, feed strip portion and a unitary head (nozzle) portion, substantially perpendicular to the feed strip portion. Fuel passages and openings in the plates are formed by selectively etching the surfaces of the plates. The plates are then arranged in surface-to-surface contact with each other and fixed together such as by brazing or diffusion bonding, to form an integral structure. Selectively etching the plates allows multiple fuel circuits, single or multiple nozzle assemblies and cooling circuits to be easily provided in the injector. The etching process also allows multiple fuel paths and cooling circuits to be created in a relatively small cross-section, thereby, reducing the size of the injector.

The feed strip portion of the plate assembly is mechanically formed such as by bending to provide the convoluted form. In one embodiment the plates all have a T-shape in plan view. In this form, the head portions of the plate assembly can be mechanically formed into a cylinder having an annular cross-section, or other appropriate shape. The ends of the head can be spaced apart from one another, or can be brought together and joined, such as by brazing or welding. Spray orifices are provided on the radially outer surface, radially inner surface and/or ends of the cylindrical nozzle to direct fuel radially outward, radially inward and/or axially from the nozzle.

It is desirable to have a fuel conduit that is more flexible, has less bending stress, and is therefore less susceptible to low cycle fatigue than a single feed strip design. For example, individual strips of a dual strip design, each having thickness ½ that of a single strip design will have about ⅛ the stiffness of a single strip and therefore significantly reduced LCF stresses for the same thermal growth differential. It is also desirable to have inherent damping to reduce vibratory stresses. The dual strip design has inherent damping and is therefore less susceptible to high cycle fatigue than the single feed strip design. It is also desirable to have a feed strip with convolutions along its length to provide increased relative displacement flexibility along the axis of the stem and reduce stresses caused by differential thermal expansion due to the extreme temperatures in the combustion chamber. It is also desirable to have a feed strip that provides a smaller envelope for the heat shield which, in turn, has a small circumferential width in the flow and lower drag and associated flow losses making for a more aerodynamically efficient design.

BRIEF DESCRIPTION OF THE INVENTION

A fuel injector conduit has at least two generally parallel feed strips that are not bonded together along substantially their entire lengths. Each of the feed strips is constructed from a single bonded together pair of lengthwise extending plates and each plate has a single row of widthwise spaced apart and lengthwise extending parallel grooves. The plates in each of the strips are bonded together such that opposing grooves in each of the plates are aligned forming internal fuel flow passages through the length of the strip from an inlet end to an outlet end of the strip. The inlet ends are spaced apart from each other. Each of the feed strips has one or more convolutions along a length of the strips and the feed strips are not bonded together along the length of the strips that include the convolutions. The feed strips have fuel inlet holes in the inlet ends and are connected to the internal fuel flow passages. Each of the internal fuel flow passages is connected to at least one of the inlet holes. The convolutions of the feed strips may be spaced apart from each other or may be in contact with each other.

An exemplary embodiment of the fuel injector includes an upper housing, a hollow stem depending from the housing, at least one fuel nozzle assembly supported by the stem, and the fuel injector conduit extending between the housing through the stem to the nozzle assembly. The injector includes a fitting fluidly connecting all of the outlet ends to a single nozzle fuel conduit of the fuel nozzle assembly. The nozzle is constructed from a multi-layered arrangement of plates with internal fuel flow circuits located between the plates. Multiple spray orifices are fluidly connected to the internal fuel flow passages in the feed strips by the internal flow circuits. The injector has at least one fuel dispensing nozzle which may have a cylindrical configuration. The fuel dispensing nozzle may be a main nozzle and the injector further includes a pilot nozzle disposed centrally within the fuel nozzle. The pilot nozzle is fluidly connected to at least one of the internal flow circuits.

The present invention provides a fuel conduit that is more flexible, which reduces bending stress, and has inherent damping, which reduces vibratory stresses, and therefore is less susceptible to both low cycle and high cycle fatigue than a single feed strip design. The feed strip of the present invention has improved relative displacement flexibility along the axis of the stem and improved reduction of stresses caused by differential thermal expansion due to the extreme temperatures in the combustion chamber. The present invention provides for a fuel conduit that allows the use of a smaller envelope for the heat shield which, in turn, has a small circumferential width in the flow and, therefore, lowers drag and associated flow losses making for a more aerodynamically efficient design.

DETAILED DESCRIPTION OF THE INVENTION

Figure 1:
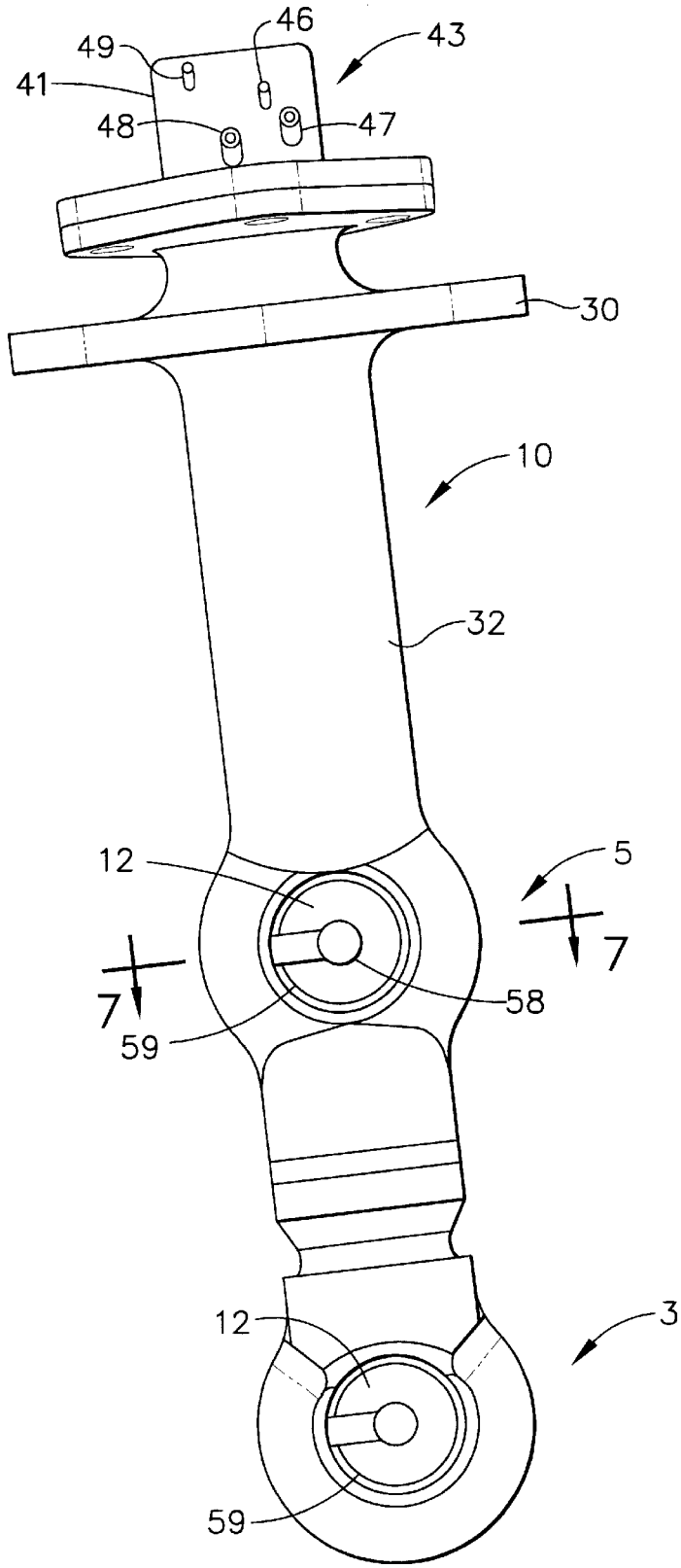
FIG. 1 is an elevated perspective aft looking forward view illustration of a first exemplary embodiment of a fuel injector of the present invention having two fuel nozzle assemblies.
Figure 2:
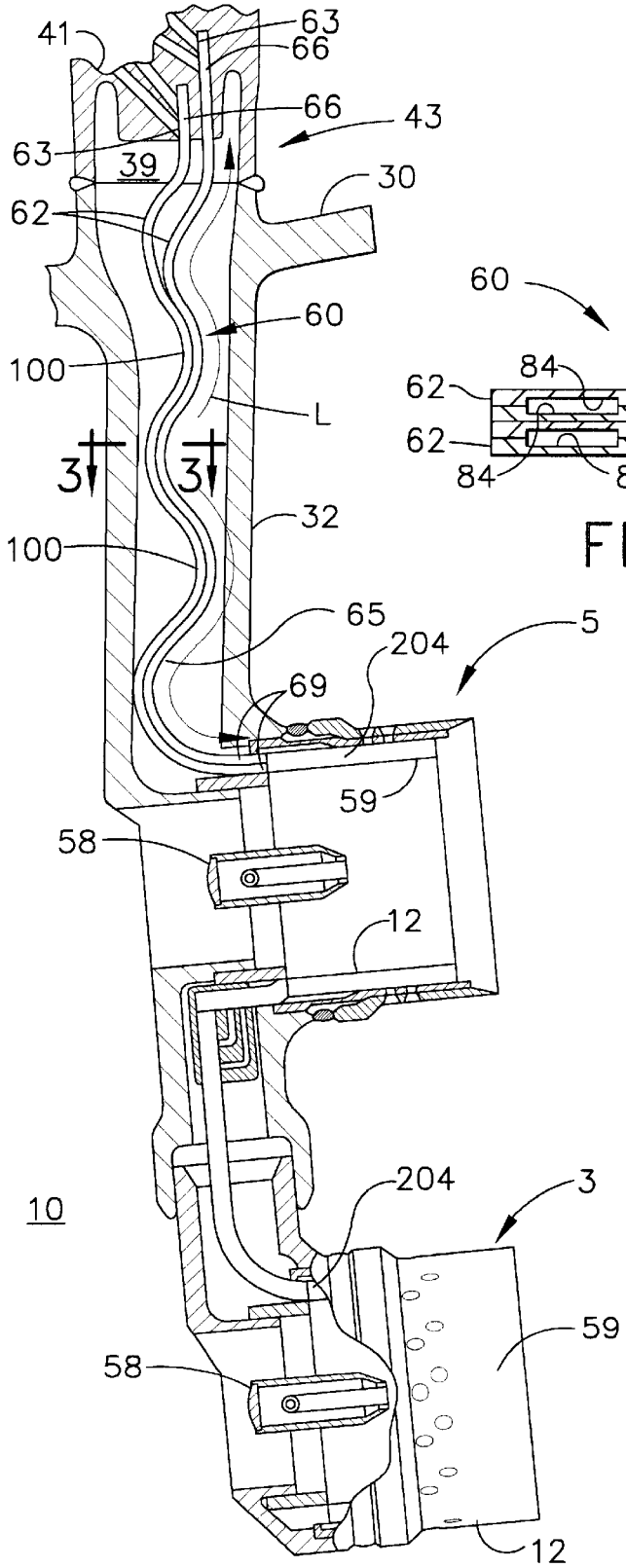
FIG. 2 is a cross-sectional side view illustration of the fuel injector in FIG. 1.

Illustrated in FIGS. 1 and 2 is an exemplary embodiment of a fuel injector 10 of the present invention having two (or more) radially inner and outer nozzle assemblies 3 and 5 for directing fuel into radially inner and outer zones of a combustion chamber of a gas turbine engine. The fuel injector 10 illustrated in FIG. 4 has a single fuel nozzle assembly 12 for directing fuel into a combustion zone of a combustion chamber of a gas turbine engine. The invention may be used with a fuel injector having two or more radially inner and outer nozzle assemblies for directing fuel into radially inner and outer zones of a combustion chamber of a gas turbine engine. The invention is further disclosed within the context of the fuel injector 10 having the single fuel nozzle assembly 12.

Figure 4:
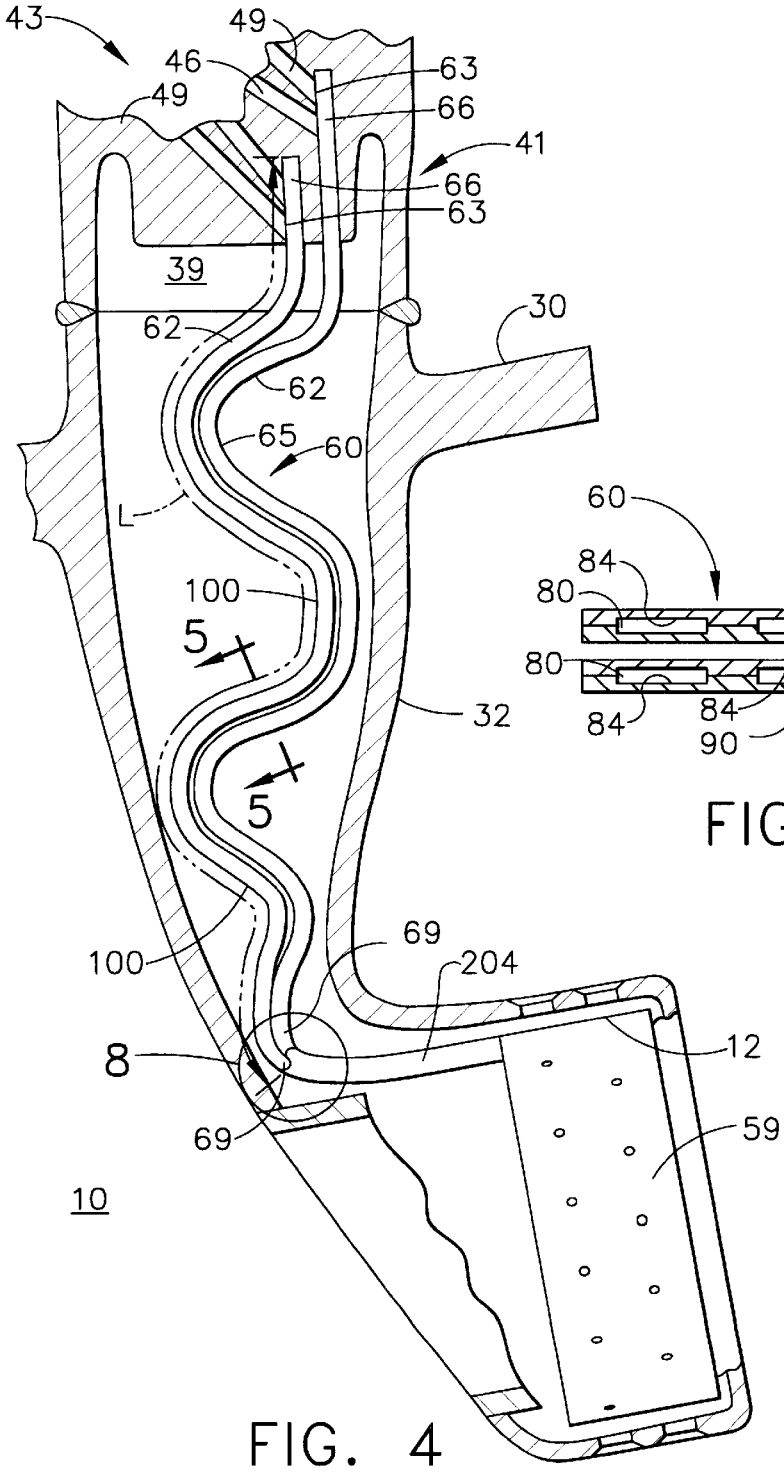
FIG. 4 is a cross-sectional side view illustration of a second exemplary embodiment of a fuel injector of the present invention having a single fuel nozzle assembly and spaced apart convolutions of the fuel strips.

The fuel injector 10 illustrated in FIG. 4 has a single fuel nozzle assembly 12 for directing fuel into a combustion zone of a combustion chamber of a gas turbine engine. The invention may be used with a fuel injector having two or more radially inner and outer nozzle assemblies for directing fuel into radially inner and outer zones of a combustion chamber of a gas turbine engine. The invention is further disclosed within the context of the fuel injector 10 having the radially inner and outer nozzle assemblies 3 and 5 and individual nozzle assemblies which will be generally referred to as the fuel nozzle assembly 12.

Figure 9:
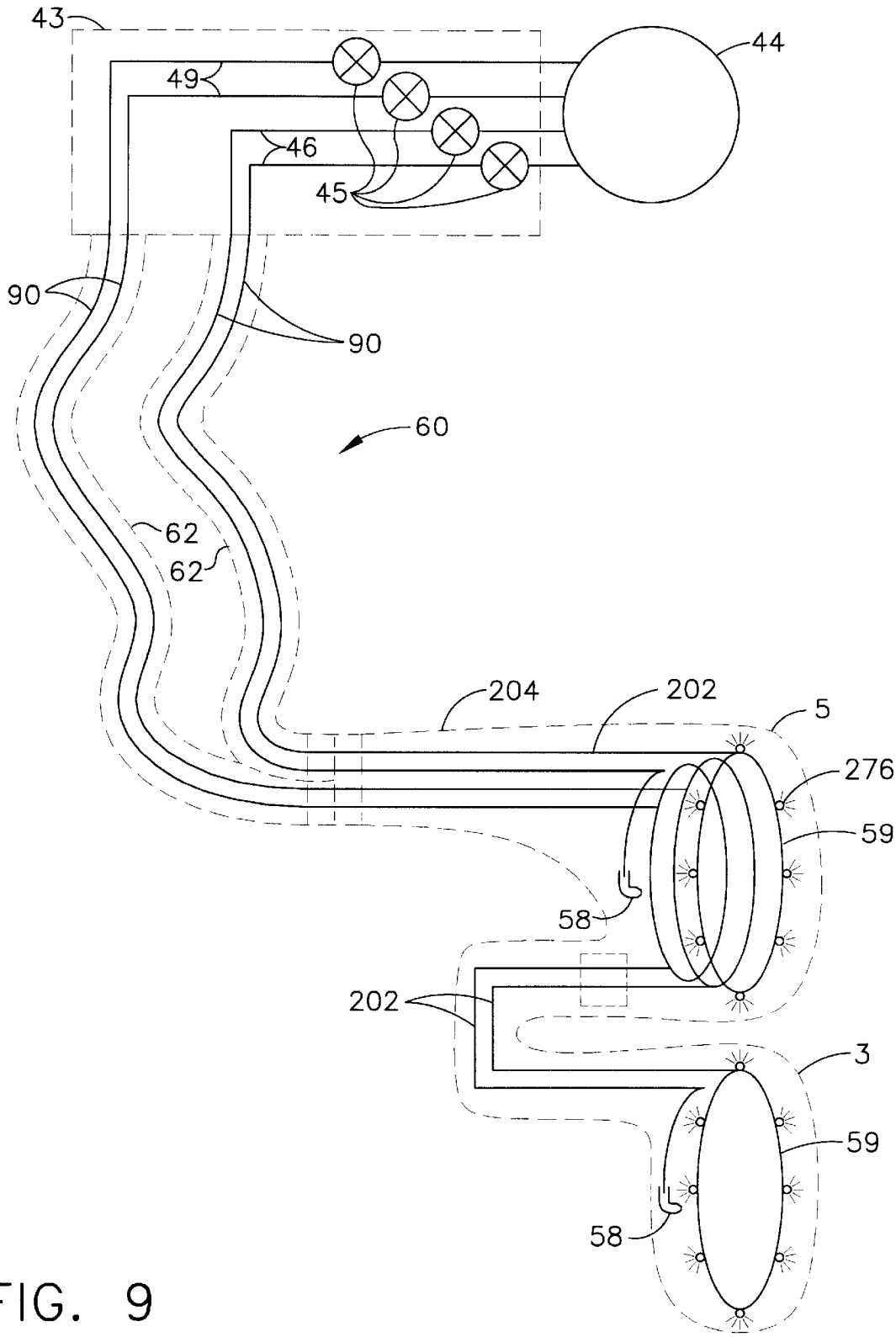
FIG. 9 is a schematical illustration of the fuel injector in FIG. 1.

Referring to FIGS. 1, 2, 4, and 9, the fuel injector 10 further includes a nozzle mount or flange 30 adapted to be fixed and sealed to a combustor casing. A hollow stem 32 is integral with or fixed to flange 30 (such as by brazing or welding) and supports the fuel nozzle assembly 12. The hollow stem 32 has an inlet assembly 41 disposed above or within an open upper end of a chamber 39 and is integral with or fixed to flange 30 such as by brazing. Inlet assembly 41 may be part of a valve housing 43 with the hollow stem 32 depending from the housing. The housing 43 is designed to be fluidly connected to a fuel manifold 44 to direct fuel into the injector 10. The inlet assembly 41 is operable to receive fuel from the fuel manifold 44 as illustrated in FIG. 9 and is integral with or fixed to and located radially outward of the flange 30. The inlet assembly 41 includes fuel valves 45 to control fuel flow through fuel circuits 202 in the fuel nozzle assembly 12. The nozzle assembly 12 has pilot and main nozzles 58 and 59, respectively. Generally, the pilot and main nozzles are used during normal and extreme power situations while only the pilot nozzle is used during start-up and part power operation.

A flexible fuel injector conduit 60 having at least two generally parallel elongated feed strips 62, that are not bonded together, provide fuel from the inlet assembly 41 to the nozzle assembly 12. The feed strips 62 are flexible feed strips formed from a material which can be exposed to combustor temperatures in the combustion chamber without being adversely affected and have convoluted shapes. Each of the feed strips 62 includes at least one or more lengthwise extending convolutions 65, which may also be regular or irregular bends or waves, along a longitudinal length L of the strips from inlet ends 66 to outlet ends 69. The feed strips 62 are not bonded together from the inlet ends 66 through the convolutions 65. The embodiment of the invention illustrated in FIGS. 2 and 3 has feed strips 62 with convolutions 65 that are in contact with each other. The embodiment of the invention illustrated in FIGS. 4 and 5 has feed strips 62 each of which has convolutions 65 that are spaced apart from each other or that are not in contact with each other. In the exemplary embodiment of the invention, the feed strips 62 are bonded together only near and along the outlet ends 69 as shown in FIG. 8.

Figure 3:
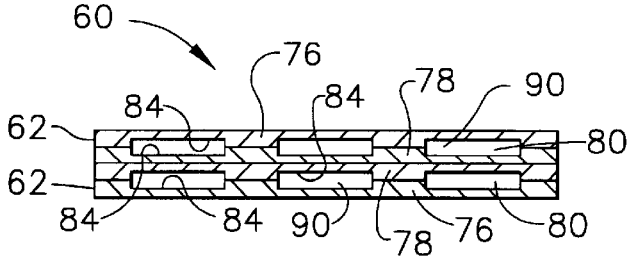
FIG. 3 is a cross-sectional view illustration of the contacting fuel strips taken though 3—3 in FIG. 2.
Figure 5:
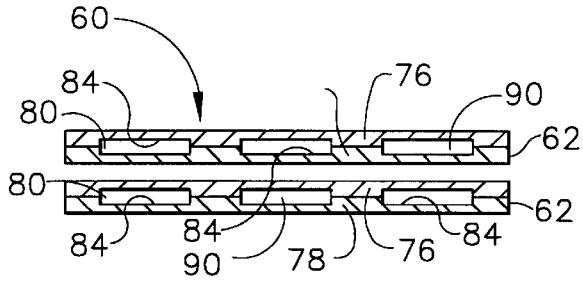
FIG. 5 is a cross-sectional view illustration of spaced apart portions of the fuel strips taken though 5—5 in FIG. 4.

Referring to FIGS. 3 and 5, each of the feed strips 62 has a single bonded together pair of lengthwise extending first and second plates 76 and 78, respectively, and each of the plates has a single row 80 of widthwise spaced apart and lengthwise extending parallel grooves 84. The first and second plates 76 and 78 in each of the strips 62 are bonded together such that opposing grooves 84 in each pair of the plates are aligned forming internal fuel flow passages 90 through the length L of the strip 62 from an inlet end 66 to an outlet end 69 of the strip. The inlet ends 66 are spaced apart from each other. Each of the feed strips 62 have one or more bends or convolutions 100 along the length L of the strip. The feed strips 62 have fuel inlets 63 (see FIG. 6) in the inlet ends 66 connected to the internal fuel flow passages 90 and in the exemplary embodiment of the invention illustrated herein, each of the internal fuel flow passages is connected to at least one of the inlet holes.

Figure 6:
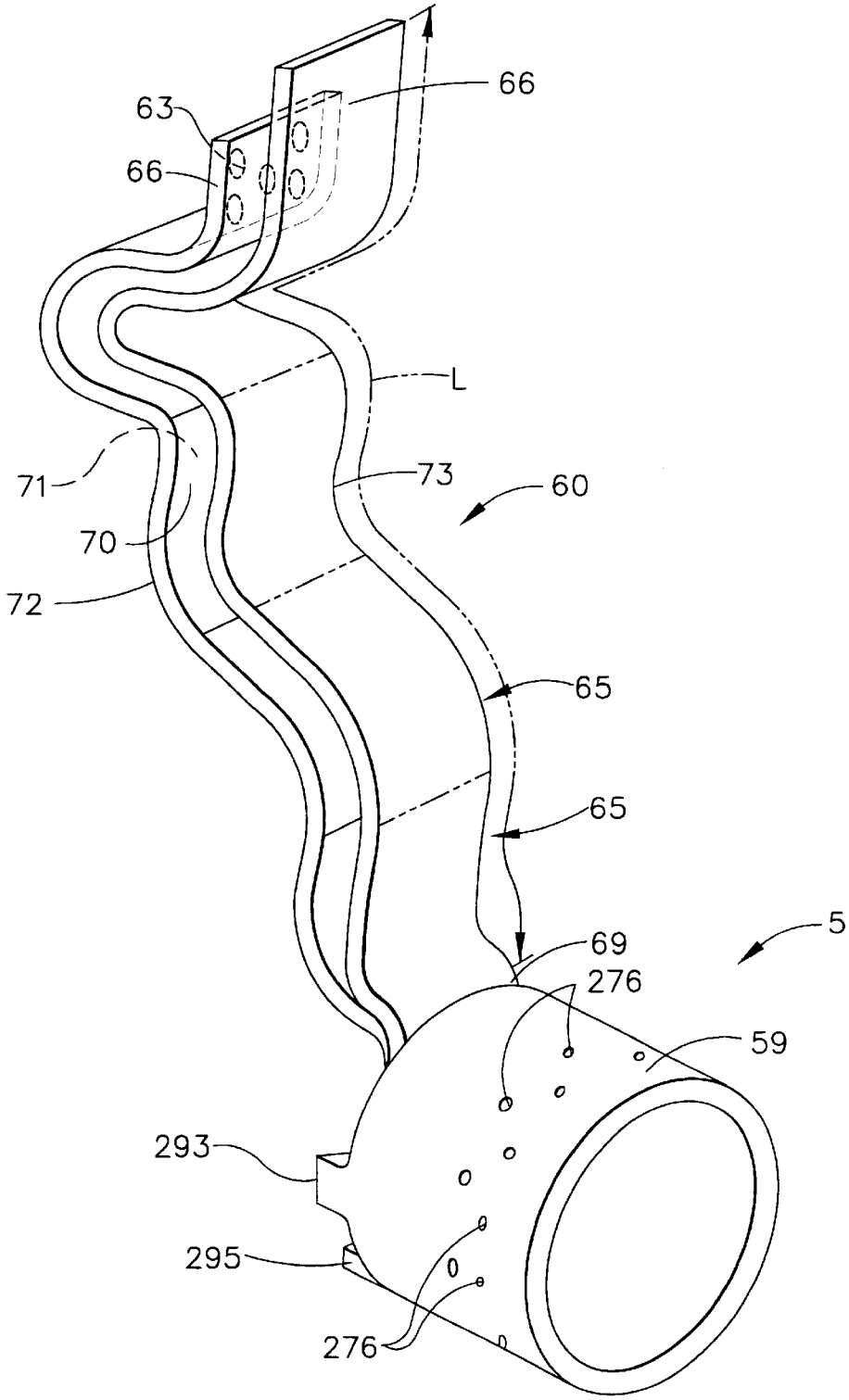
FIG. 6 is an elevated perspective view illustration of the fuel strips with spaced apart convolutions and a radially outer fuel nozzle assembly of the injector in FIG. 1.

Further referring to FIG. 6, the convoluted shape of the feed strips 62 allows expansion and contraction of the feed strips in response to thermal changes in the combustion chamber, while reducing mechanical stresses within the injector. The convoluted feed strips helps reduce or eliminate the need for additional heat shielding of the stem portion in many applications, although in some high-temperature situations an additional heat shield may still be necessary or desirable. The term strip means that the feed strip has an elongated, essentially flat shape, where first and second side surfaces 70, 71 of the strip are essentially parallel, and oppositely facing from each other, and the essentially first and second perpendicular edges 72, 73 of the strip are also essentially parallel and oppositely-facing. The strip has essentially a rectangular shape in cross-section (as compared to the cylindrical shape of a typical fuel tube), although this shape could vary depending upon manufacturing requirements and techniques. The feed strips should have a sufficient number of convolutions along the length of the strip to allow the strip to easily absorb thermal changes within the combustion chamber without providing undue stress on the inlet assembly 41 and the nozzle assembly 12. The strips should not have so many convolutions so as to cause the strip to exhibit resonant behavior in response to combustion system stimuli. The number and configuration of the convolutions appropriate for the particular application can be determined by experimentation and analytical modeling and/or resonant frequency testing.

Figure 7:
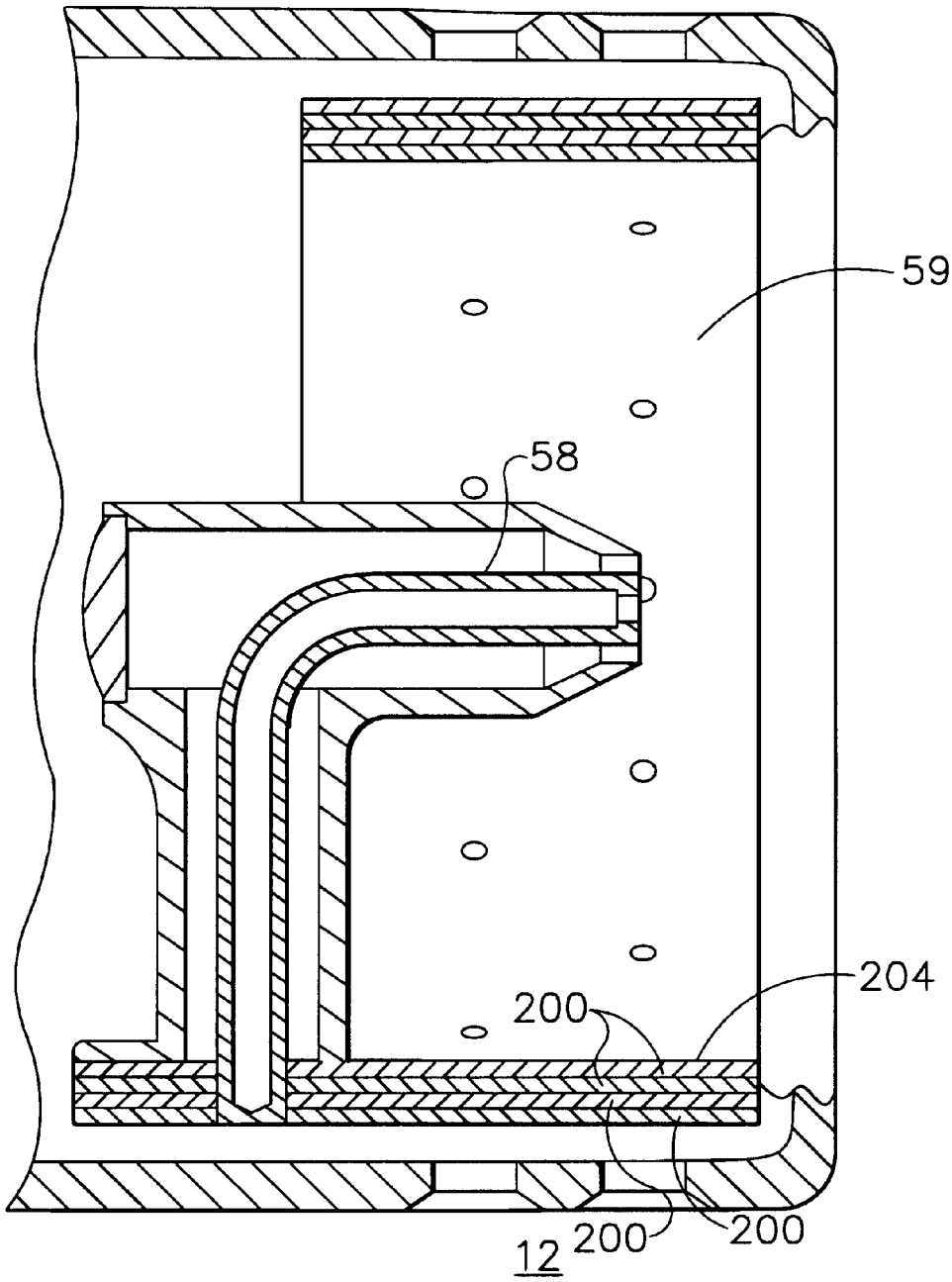
FIG. 7 is a cross-sectional view illustration of the radially outer fuel nozzle assembly taken though 7—7 in FIG. 1.
Figure 8:
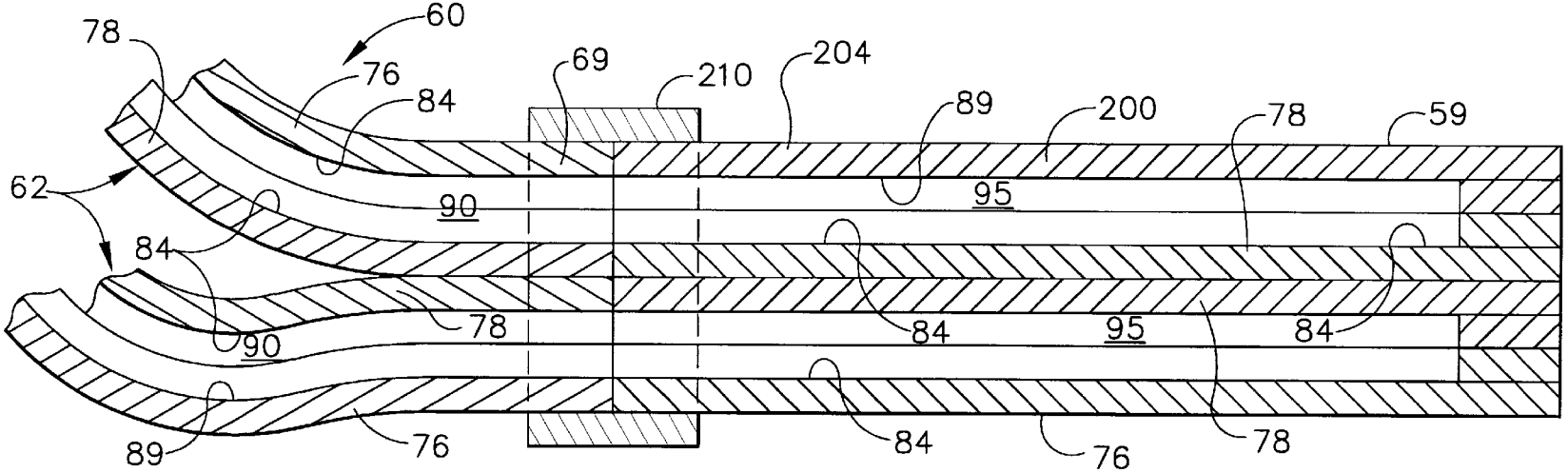
FIG. 8 is a cross-sectional side view illustration of the fuel strips connected to the fuel nozzle assembly.

Referring to FIGS. 2–9, the inlets 63 at the inlet ends 66 of the feed strips 62 fluidly connect with first, second, third, or fourth inlet ports 46, 47, 48, and 49 respectively in the inlet assembly 41 to direct fuel into the feed strips. The inlet ports feed the multiple internal fuel flow passages 90 down the length of the feed strips 62 to the pilot nozzle 58 and main nozzle 59 in the nozzle assembly 12 as well as provide cooling circuits for thermal control in the nozzle assembly. A header 204 of the nozzle assembly 12 receives fuel from the strips 62 and conveys the fuel to the main nozzle 59 and, where incorporated, to the pilot nozzle 58 through the fuel circuits 202 as illustrated in FIGS. 8 and 9. The main nozzle 59 and the header 204 are integrally constructed from a plurality of laminated bonded plates 200 that have a plurality of fuel circuits 202 including fuel paths 95 located between the bonded plates constructed of the widthwise spaced apart and lengthwise extending parallel grooves 84 in the bonded plates 200. The plurality of fuel circuits 202 and fuel paths 95 lead to pluralities of spray orifices 276 and to the pilot nozzle 58 as illustrated in FIG. 7. The fuel circuits 202 and the parallel grooves 84 of the fuel paths 95 are etched into adjacent surfaces of the plates 200.

A fitting 210 fluidly connects the two bonded together outlet ends of the strips 62 to the header 204 which in turn is fluidly connected to the plurality of fuel circuits 202 as illustrated in FIG. 8 and FIG. 9. See U.S. patent application Ser. No. 09/361,954 for a more detailed description of the nozzle assemblies and fuel circuits 202 between the bonded plates. Referring to FIGS. 2, 8, and 9, the internal fuel flow passages 90 down the length of the feed strips 62 are used to feed fuel to the fuel circuits 202. Fuel going into each of the internal fuel flow passages 90 in the feed strips 62 and the header 204 into the pilot and main nozzles 58 and 59 is controlled by fuel valves 45 illustrated by the inlet assembly 41 being part of the valve's housing and further illustrated schematically in FIG. 9. The header 204 of the nozzle assembly 12 receives fuel from the strips 62 and conveys the fuel to the main nozzle 59. The main nozzle 59 is annular and has a cylindrical shape or configuration. The flow passages, openings and various components of the spray devices in plates 76 and 78 can be formed in any appropriate manner such as by etching and, more specifically, chemical etching. The chemical etching of such plates should be known to those skilled in the art, and is described for example in U.S. Pat. No. 5,435,884. The etching of the plates allows the forming of very fine, well-defined, and complex openings and passages, which allow multiple fuel circuits to be provided in the feed strips 62 and nozzle 59 while maintaining a small cross-section for these components. The plates 76 and 78 can be bonded together in surface-to-surface contact with a bonding process such as brazing or diffusion bonding. Such bonding processes are well-known to those skilled in the art, and provide a very secure connection between the various plates. Diffusion bonding is particularly useful, as it causes boundary cross-over (atom interchange) between the adjacent layers.

Referring to FIGS. 6 and 2, a first outlet flange 293 is formed by the multi-plate structure for connection to the pilot nozzle 58 of the radially outer nozzle assembly 5 and includes fuel paths to direct fuel to the pilot nozzle. A second outlet flange 295 is formed for connection to the pilot nozzle 58 and the main nozzle 59 of the radially inner nozzle assembly 3 and includes fuel paths to direct fuel to the pilot nozzle 58 and the main nozzle 59 of the radially inner nozzle assembly 3.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A fuel injector conduit comprising:

at least two generally parallel feed strips, each of said feed strips having a single bonded together pair of lengthwise extending plates, each plate having a single row of widthwise spaced apart and lengthwise extending parallel grooves, said plates in each of said strips being bonded together such that opposing grooves in each of said plates are aligned forming internal fuel flow passages through the length of said strip from an inlet end to an outlet end of said strip, said inlet ends being spaced apart from each other, each of said feed strips including one or more convolutions along a length of each of said strips, and said feed strips are not bonded together along said convolutions.

2. The conduit as claimed in claim 1, wherein said feed strips have fuel inlet holes in said inlet ends connected to said internal fuel flow passages.

3. The conduit as claimed in claim 2, wherein each of said internal fuel flow passages is connected to at least one of said inlet holes.

4. The conduit as claimed in claim 1, wherein said convolutions are spaced apart from each other.

5. The conduit as claimed in claim 4, wherein said feed strips have fuel inlet holes in said inlet ends connected to said internal fuel flow passages.

6. The conduit as claimed in claim 5, wherein each of said internal fuel flow passages is connected to at least one of said inlet holes.

7. The conduit as claimed in claim 1, wherein said feed strips are in contact with each other.

8. The conduit as claimed in claim 7, wherein said feed strips have fuel inlet holes in said inlet ends connected to said internal fuel flow passages.

9. The conduit as claimed in claim 3, wherein said strips are bonded together only near and along the outlet ends.

10. A fuel injector, comprising:

an upper housing;

a hollow stem depending from said housing;

at least one fuel nozzle assembly supported by said stem;

a fuel injector conduit extending between said housing through said stem to said nozzle assembly, said fuel injector conduit comprising at least two generally parallel feed strips, each of said feed strips having a single bonded together pair of lengthwise extending plates, each plate having a single row of widthwise spaced apart and lengthwise extending parallel grooves, said plates in each of said strips being bonded together such that opposing grooves in each of said plates are aligned forming internal fuel flow passages through the length of said strip from an inlet end to an outlet end of said strip, said inlet ends being sp aced apart from each other, each of said feed strips includes at least one convolution along a length of each of said strips and, said feed strips are not bonded together along said convolutions.

11. The injector as claimed in claim 10, wherein said feed strips are spaced apart from each other.

12. The injector as claimed in claim 11, wherein said feed strips have fuel inlet holes in said inlet ends connected to said internal fuel flow passages.

13. The injector as claimed in claim 12, wherein each of said internal fuel flow passages is connected to at least one of said inlet holes.

14. The injector as claimed in claim 10, wherein said feed strips are in contact with each other.

15. The injector as claimed in claim 14, wherein said feed strips have fuel inlet holes in said inlet ends connected to said internal fuel flow passages.

16. The injector as claimed in claim 15, wherein each of said internal fuel flow passages is connected to at least one of said inlet holes.

17. The injector as claimed in claim 10, wherein said fuel nozzle assembly includes a fitting fluidly connecting all of said spaced apart outlet ends to a plurality of fuel circuits of said fuel nozzle assembly.

18. The injector as claimed in claim 17, wherein said feed strips are spaced apart from each other.

19. The injector as claimed in claim 18, wherein said feed strips have fuel inlet holes in said inlet ends connected to said internal fuel flow passages.

20. The injector as claimed in claim 19, wherein each of said internal fuel flow passages is connected to at least one of said inlet holes.

21. The injector as claimed in claim 17, wherein said feed strips are in contact with each other.

22. The injector as claimed in claim 21, wherein said feed strips have fuel inlet holes in said inlet ends connected to said internal fuel flow passages.

23. The injector as claimed in claim 22, wherein each of said internal fuel flow passages is connected to at least one of said inlet holes.

24. The injector as claimed in claim 10, wherein said nozzle includes a multi-layered arrangement of plates.

25. The injector as claimed in claim 24, wherein between said plates are internal fuel flow circuits.

26. The injector as claimed in claim 25, wherein said nozzle further includes multiple spray orifices and said internal flow circuits fluidly connect said internal fuel flow passages in said feed strips to said spray orifices.

27. The injector as claimed in claim 16, further comprising a fuel dispensing nozzle with a cylindrical configuration and annular cross-section.

28. The injector as claimed in claim 27, wherein said fuel dispensing nozzle is a main nozzle and said fuel injector nozzle assembly further includes a pilot nozzle disposed centrally within said fuel nozzle wherein said pilot nozzle is fluidly connected to at least one of said internal flow circuits.

29. The injector as claimed in claim 28, wherein said fuel nozzle assembly includes a fitting fluidly connecting all of said spaced apart outlet ends to said internal flow circuits.

30. The injector as claimed in claim 29, wherein said feed strips are spaced apart from each other.

31. The injector as claimed in claim 29, wherein said feed strips are in contact with each other.

* * * * *